US006513628B2

(12) United States Patent
Mollenauer et al.

(10) Patent No.: US 6,513,628 B2
(45) Date of Patent: Feb. 4, 2003

(54) SUPPORT FOR LIFT DOOR DRIVE

(75) Inventors: Frank Mollenauer, Berlin (DE); Bodo Graebner, Inwil (CH)

(73) Assignee: Inventio AG, Hergiswil (SE)

( * ) Notice: Subject to any disclaimer, the term of this patent is extended or adjusted under 35 U.S.C. 154(b) by 105 days.

(21) Appl. No.: 09/230,990

(22) PCT Filed: Aug. 4, 1997

(86) PCT No.: PCT/CH97/00291

§ 371 (c)(1),
(2), (4) Date: Feb. 4, 1999

(87) PCT Pub. No.: WO98/06920

PCT Pub. Date: Feb. 19, 1998

(65) Prior Publication Data

US 2001/0047909 A1 Dec. 6, 2001

(30) Foreign Application Priority Data

Aug. 13, 1996 (EP) ..... 96810537

(51) Int. Cl.[7] ..... B66B 13/06
(52) U.S. Cl. ..... 187/324; 187/315; 187/334
(58) Field of Search ..... 187/315, 324, 187/313, 318, 333, 334, 312

(56) References Cited

U.S. PATENT DOCUMENTS

| | | | | |
|---|---|---|---|---|
| 4,149,615 A | | 4/1979 | Kappenhagen | |
| 4,359,143 A | * | 11/1982 | Jackson | 187/324 |
| 4,484,411 A | * | 11/1984 | Rystad | 49/505 |
| 4,503,637 A | * | 3/1985 | Parente | 49/141 |
| 4,711,323 A | | 12/1987 | Haas | |
| 5,797,471 A | * | 8/1998 | Princell | 187/324 |

FOREIGN PATENT DOCUMENTS

| | | | | |
|---|---|---|---|---|
| EP | 332 841 | | 4/1992 | |
| EP | 513 509 | | 11/1992 | |
| FR | 002597459 | * | 10/1987 | 187/315 |
| GB | 2214488 | * | 9/1989 | 187/393 |
| JP | 2-8186 | * | 1/1990 | 187/324 |

* cited by examiner

*Primary Examiner*—Robert P. Olszewski
*Assistant Examiner*—Steven B. McAllister
(74) *Attorney, Agent, or Firm*—Cohen, Pontani, Lieberman & Pavane

(57) ABSTRACT

A carrier for the reception of all important components of a door drive. The carrier has a base part and a length adapter, which are connectible together in such a manner that carriers of different lengths can be produced so that the carrier can be used in different door systems with different entrance widths.

10 Claims, 3 Drawing Sheets

SUPPORT FOR LIFT DOOR DRIVE

BACKGROUND OF THE INVENTION

1. Field of the Invention

The invention relates to a carrier for door drives of lifts.

2. Discussion of the Prior Art

Carriers of the kind which are mounted on the roof of an elevator cage at the door side, serve for the reception of all important components for the door drive, such as, for example, translation gear, belt drive, motor bearer with drive motor, guide rails, etc. In general, in the case of door drives for elevators such as have become known by, for example, U.S. Pat. No. specification 4,149,615 or European patent specification 0, 513,509, the carriers are conceived on each occasion only for a specific door system. In the case of different door systems with different entrance widths, carriers of different lengths matched to the entrance widths are required for the aforesaid door drives, whereby warehousing is more costly and the door drives are more expensive.

SUMMARY OF THE INVENTION

The invention is based on the object of providing a carrier of the kind stated in the introduction, which does not have the above-mentioned disadvantages.

Pursuant to this object, and others which will become apparent hereafter, one aspect of the invention resides in a carrier having consists of a base part and a length adapter, which are connectable together in such a manner that carriers of different lengths can be produced.

The advantages achieved by the invention are to be seen in that one and the same carrier can be used for different door systems with different entrance widths (for example, 600 to 800 millimeters). With the carrier the drive components can be arranged in such a manner that it is possible to reach all important components from the storey. The carrier according to the invention has a geometric form which offers mechanical protection for the belt drive unit, whereby, in particular, a protection against objects, dirt, water, etc., falling down as well as against wanton destruction by elevators users is guaranteed. The carrier is adjustable not only horizontally, but also vertically, so that an adaptation to different cages and compensation for tolerances are possible. Costs can be saved by this carrier and warehousing simplified. The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

BRIEF DESCRIPTION OF THE DRAWING

The invention is more closely explained in the following by reference to an example of embodiment in conjunction with the drawings, in which.

DETAILED DESCRIPTION OF THE PREFERRED EMBODIMENTS

Figure 1:
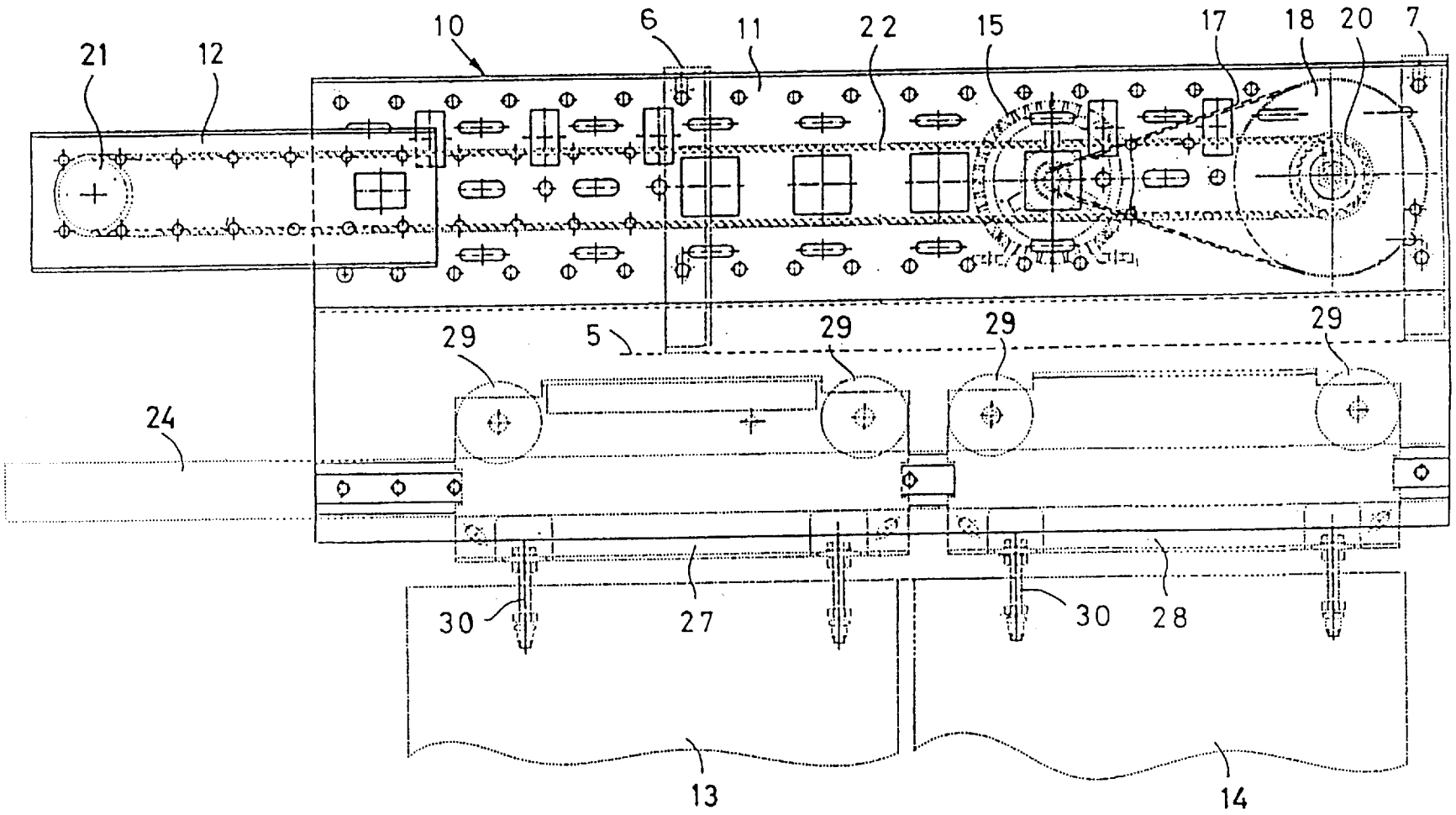
FIG. 1 shows an elevation of the carrier according to the invention, with mounted door drive components.
Figure 2:
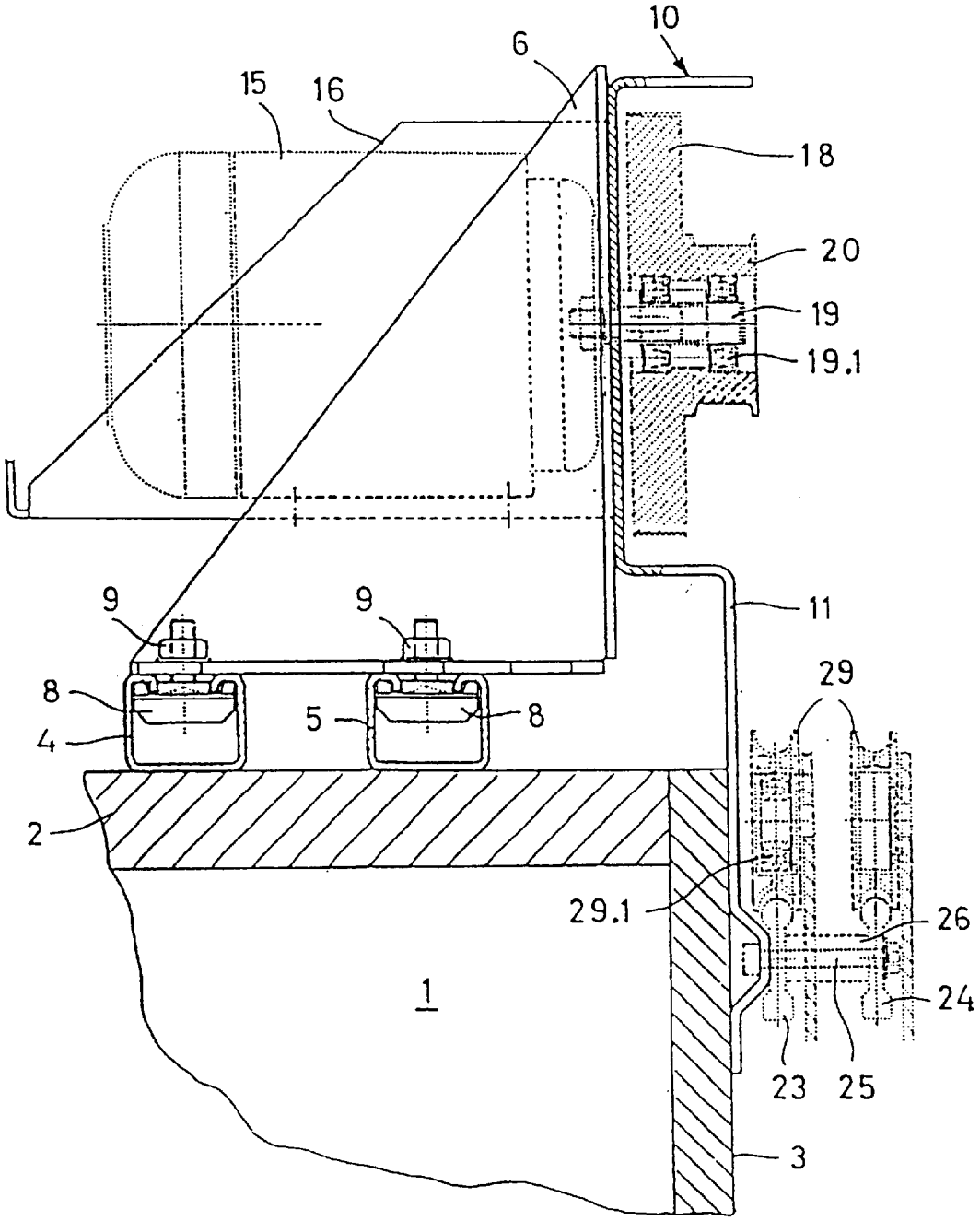
FIG. 2 shows a partially sectioned side elevation of the carrier with door drive components, in a scale enlarged relative to FIG. 1.

A cage roof is designated by 2 and the front side of an elevator cage 1 by 3 in FIG. 2. Two C-section profile rails 4, 5, to which two support brackets 6 and 7 are fastened, are arranged on the cage roof 2. The support brackets 6, 7 are screw-connected with the C-section profile rails 4, 5 by means of rotationally fast screws 8, which are guided in the C-section profile rails, and nuts 9. A carrier 10, which consists of a base part 11 and a length adapter 12 and is more closely described in the following by reference to FIGS. 3 to 6, is fastened to the support brackets 6, 7. The carrier 10 is screw-connected with the support, 7 merely by way of the base part 11, whereas the length adapter 12 is connected with the base part 11. The most important components of a door drive, by means of which a door, consisting of two door leaves 13, 14, of the elevator cage 1 can be opened and closed, are arranged at the carrier 10. In FIGS. 1 and 2 these components fastened to the carrier 10 are illustrated merely by dotted lines and are briefly described in the following.

An electric motor 15 is screw-connected with the base part 11 of the carrier 10 by way of a motor bracket 16 and drives a belt pulley 18 by way of a belt 17. The belt pulley 18 is rotatably mounted by means of ball bearings 19.1 on a pin 19 fastened to the base part 11 and connected rotationally fast with a toothed belt pulley 20. A further toothed belt pulley 21 is rotatably mounted on the length adapter 12, which is screw-connected with the base part 11, and stands under the effect of a tensioning device, which is not illustrated, so that a toothed belt 22 guided over the toothed belt pulleys 20 and 21 always has a sufficient tension. Guide rails, 23, 24 are screw-connected with the base part 11 by way of screws 25 and spacers 26, are. Support rollers 29 are guided on the guide rails 23, 24 and are rotatably arranged at guide carriages 27, 28 by way of ball bearings 29. The guide carriages 27, 28 are firmly connected with the door leaves 13, 14 by way of screw bolts 30.

Door drives of the kind briefly described in the foregoing are known. Reference is therefore made to, for example, European reference EP-A 0 332 841 and EP-B 0 513 509 for further not-illustrated details such as, for example, the movement transmission from the toothed belt 22 to the guide carriages 27 or 28 or the entraining equipment for the cage door and the shaft door.

Figure 4:
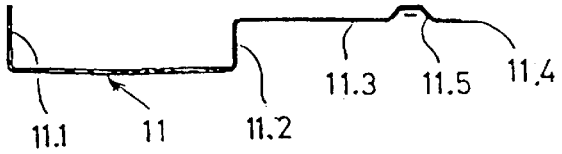
FIG. 4 shows a cross-section of the base part according to FIG. 3.
Figure 3:
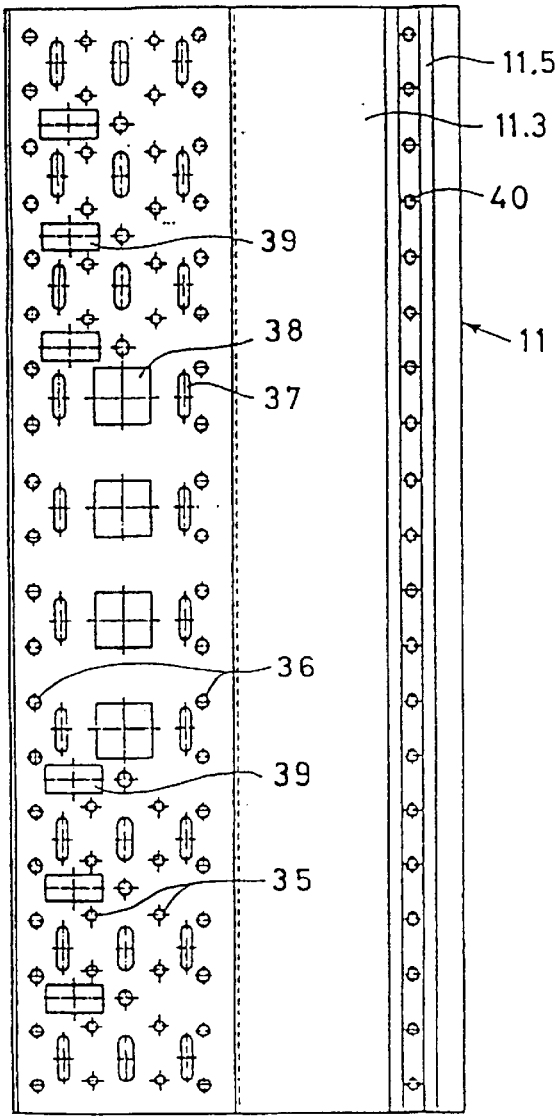
FIG. 3 shows an elevation of a base part of the carrier.

According to FIGS. 3 and 4, the base part 11, which consists of, for example, sheet steel, of the carrier 10 has a substantially U-shaped cross-section. In order to better protect the belt drive unit, the one U limb 11.1 of the base part 11 is longer than the other U limb 11.2. A prolongation 11.3, which is bent over at right angles and rests on the front side 3 of the lift cage 1 (FIG. 2), is provided at the other U limb 11.2. Two rows of first bores 35 and two rows of second bores 36 are provided in the base part 11. Moreover, the base part 11 similarly has elongate holes 37, square passages 38 and rectangular passages 39 arranged in rows. A shaped-out portion 11.5 of trapezium-shaped cross-section is provided in the region of a lower longitudinal edge 11.4 of the prolongation 11.3. The trapezium-shaped shaped-out portion 11.5 has a row of threaded holes 40, which are, for example, reinforced by means of drawn-through elements and are intended for the fastening of the guide rails 23 and 24. The square passages 38 are provided for the axle of the electric motor 15 and a belt pulley arranged on the axle. The rectangular passages 39 serve as cutouts for an infrared incremental transmitter of the door drive control. The elongate holes 37 are intended for the fastening of the motor bracket 16 and a carrier plate for the door drive electronic unit. The bores 35 and 36, elongate holes 37, passages 38 and 39 and threaded holes 40 preferably have a predetermined constant spacing from one another. The most diverse variants of the arrangement of the most important components are possible by the multiplicity of the different holes or passages, so that an optimum adaptation to construction conditions can be achieved.

Figure 6:
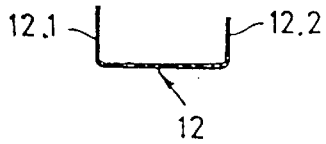
FIG. 6 shows a cross-section of the length adapter according to FIG. 5.
Figure 5:
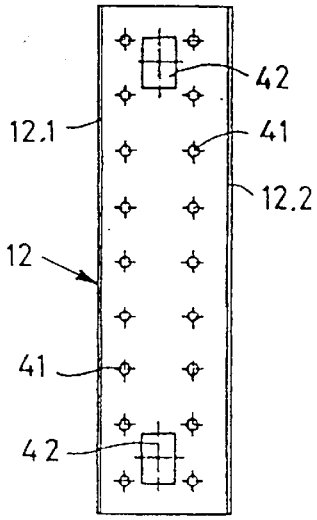
FIG. 5 shows an elevation of a length adapter of the carrier.

The length adapter made of, for example, sheet steel has, according to FIGS. 5 and 6, a U-shaped cross-section which is smaller than the U-shaped cross-section of the base part 11. In order to better protect the belt drive unit, the one U limb 12.1 of the length adapter 12 is longer than the other U limb 12.2, wherein the U limbs 12.1 and 12.2 of the length adapter 12 are approximately equal in length to the U limbs 11.1 and 11.2 of the base part 11. Two rows of further bores 41, which are congruent with the first bores 35 of the base part 11, are provided in the length adapter 12. The length adapter 12 is used with greater door widths, wherein it can be adjusted in steps corresponding to the predetermined hole spacings and can be screw-connected with the base part 11. Rectangular passages, which are necessary for the mounting of the above-mentioned belt tensioning device, are designated by 42. The invention is not limited by the embodiments described above which are presented as examples only but can be modified in various ways within the scope of protection defined by the appended patent claims.

What is claimed is:

1. A carrier for elevator door drives, comprising:

a longitudinally symmetrical base part having a length; and a longitudinally symmetrical length adapter which is selectively connectable to the base part at variable locations along the length of the base part so that an overall length of the carrier together with the adapter is variable, the base part having a plurality of holes symmetrically arranged along its entire length whereby the elevator door drive is mountable at different positions, the base part and the adapter being configured such that the adapter can mount to either longitudinal end of the base part.

2. A carrier according to claim 1, wherein the base part has at least two rows of first holes, and two rows of further holes are provided in the length adapter so that the first holes and the further holes correspond and have a predetermined constant spacing from one another.

3. A carrier according to claim 2, wherein the base part has a substantially U-shaped cross-section, perpendicular to a longitudinal axis of the base part, with one U limb longer than another U limb.

4. A carrier according to claim 3, wherein a prolongation is provided so as to extend at a right angle from the another U limb of the base part.

5. A carrier according to claim 4, wherein a recessed portion is provided in a region of a lower longitudinal edge of the prolongation of the base part, the recessed portion having a row of threaded holes.

6. A carrier according to claim 3, wherein the length adapter has a U-shaped cross-section which is smaller than the U-shaped cross-section of the base part, a part of the length adapter lying within the U limbs of the base part and being connectable with the base part.

7. A carrier according to claim 6, wherein the U-shaped cross-section of the length adapter has one U limb that is longer than another U limb, the one U limb of the length adapter being approximately equal in length to the one U limb of the base part and the another U limb of the length adapter being approximately equal in length to the another U limb of the base part.

8. A carrier according to claim 1, wherein the plurality of holes include elongated holes arranged in rows in the base part.

9. A carrier according to claim 1, wherein the plurality of holes include square and rectangular passages arranged in rows in the base part.

10. A carrier according to claim 1, wherein rectangular passages are provided in the length adapter.

* * * * *